US006945681B2

(12) United States Patent
Larsen

(10) Patent No.: US 6,945,681 B2
(45) Date of Patent: Sep. 20, 2005

(54) HEADLAMP ASSEMBLIES AND OPTICAL BODIES FOR USE THEREWITH

(75) Inventor: Michael K. Larsen, Macomb Township, MI (US)

(73) Assignee: General Motors Corporation, Detroit, MI (US)

( * ) Notice: Subject to any disclaimer, the term of this patent is extended or adjusted under 35 U.S.C. 154(b) by 22 days.

(21) Appl. No.: 10/669,546

(22) Filed: Sep. 24, 2003

(65) Prior Publication Data

US 2005/0063191 A1 Mar. 24, 2005

(51) Int. Cl.[7] ..... F21V 9/00

(52) U.S. Cl. ..... 362/510; 362/511; 362/516; 362/583

(58) Field of Search ..... 362/255, 256, 362/510, 511, 516, 520, 583

(56) References Cited

U.S. PATENT DOCUMENTS 6,513,962 B1 * 2/2003 Mayshack et al. ..... 362/583
2002/0071267 A1 * 6/2002 Lekson et al. ..... 362/511
2002/0085384 A1 * 7/2002 Tiesler-Wittig ..... 362/511

FOREIGN PATENT DOCUMENTS

WO WO 01/69300 A2 9/2001

* cited by examiner

*Primary Examiner*—Stephen F Husar
(74) *Attorney, Agent, or Firm*—Laura C. Hargitt

(57) ABSTRACT

Headlamp assemblies utilize a solid optical body made of glass or another heat resistant, light transmissive material. The solid optical body has an axially positioned cavity therethrough which receives a bulb that injects light through a cylindrical wall of the cavity into the optical body. In order to reflect light from the bulb, the optical body has a rear surface which is coated with a reflecting material, such as aluminize or a dichroic material. In accordance with one embodiment of the invention in which a plastic lens is used, the optical body is made of glass with a dichroic coating configured so that the infrared component of light from the bulb is transmitted through the dichroic coating and emitted through the rear of the optical body. This reduces transmission of heat from the bulb to the plastic lens so that the lens can be positioned closer to the optical body, which decreases the fore/aft extent of the headlamp assemblies. In another embodiment of the invention the dichroic coating is tuned not to reflect yellow wavelength light.

6 Claims, 3 Drawing Sheets

HEADLAMP ASSEMBLIES AND OPTICAL BODIES FOR USE THEREWITH

FIELD OF THE INVENTION

The present invention is directed to headlamp assemblies and optical bodies for use therewith. More particularly, the present invention is directed to headlamp assemblies generally and optical bodies that can reduce the size of headlamp assemblies while maintaining or improving their optical performance.

BACKGROUND OF THE INVENTION

As automotive vehicles evolve, there is a continuing effort to reduce the size of components. This is done for many reasons, such as to provide increased room in passenger and engine compartments; to provide additional space for structural elements and to accommodate design flexibility. With respect to vehicular headlamp assemblies there is a need to make headlamp assemblies shorter in the fore/aft direction and smaller in both vertical and horizontal extent so that headlamps require less space. It is necessary to at least preserve headlamp performance while decreasing size. Size reduction is desirable for all types of road illumination devices, including low beam headlamps, high beam headlamps, front fog lamps, auxiliary low beams, and auxiliary high beams Low and high beam lamps using halogen, high intensity discharged (HID) or xenon bulbs, generate considerable heat which tends to melt plastic headlamp lenses, usually made from polycarbonate, e.g. LEXON®, if the lenses are mounted too close to the optical system. Consequently, plastic lenses must be spaced from bulb tips by a distance in the range of 35–75 mm. Reducing this clearance would help decrease the fore/aft dimension of headlamp assemblies, thus providing additional space behind the headlamp assemblies, which space could be utilized for other purposes.

SUMMARY OF THE INVENTION

In view of the aforementioned considerations, the present invention is directed to headlamp or fog lamp optical systems comprising an optical body made of a light transmissive material, the optical body having a rear surface that is substantially convex and a front surface. A cavity extends in the optical body for receiving a light source therein, the cavity being defined by a light transmissive surface that extends from the rear surface toward the front surface of the optical body. A concave reflective surface is provided on the substantially convex rear surface of the optical body for reflecting light in a collimated beam toward and through the front surface of the optical body.

In accordance with other aspects of the invention, the reflective surface is either metallic or dichroic.

In accordance with one embodiment of the invention, the light transmissive material of the optical body is glass.

In still a further aspect of the invention, the optical body is made of light transmissive glass, is formed about an axis and has having a convex rear surface and a front surface. A cavity extends along the axis into the optical body from the convex rear surface toward the front surface, the cavity being defined by a light transmissive wall that refracts light as light passes therethrough. A bulb is disposed in the cavity and emits light laterally with respect to the axis of the optical body for refraction through the light transmissive wall of the cavity into the optical body. The convex rear surface of the optical body has a concave reflective coating thereon for reflecting light from the filament bulb in a collimated beam toward the front surface of the optical body. The front surface of the optical body refracts the collimated light reflected from the reflector out of the optical body.

In still a further aspect of the invention, the concave reflective coating on the convex rear surface of the glass optical body is a dichroic coating.

In still a further aspect of the invention, the dichroic coating on the glass optical body has both reflective and transmissive components, the reflective components reflecting visible light through the front surface of the optical body and the transmissive components transmitting infrared light out of the substantially convex rear surface of the optical body.

In still another aspect of the invention, the dichroic coating is tuned not reflect portions of yellow wavelength light.

In another embodiment of the invention, the convex rear surface of the optical body is a scalloped surface.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
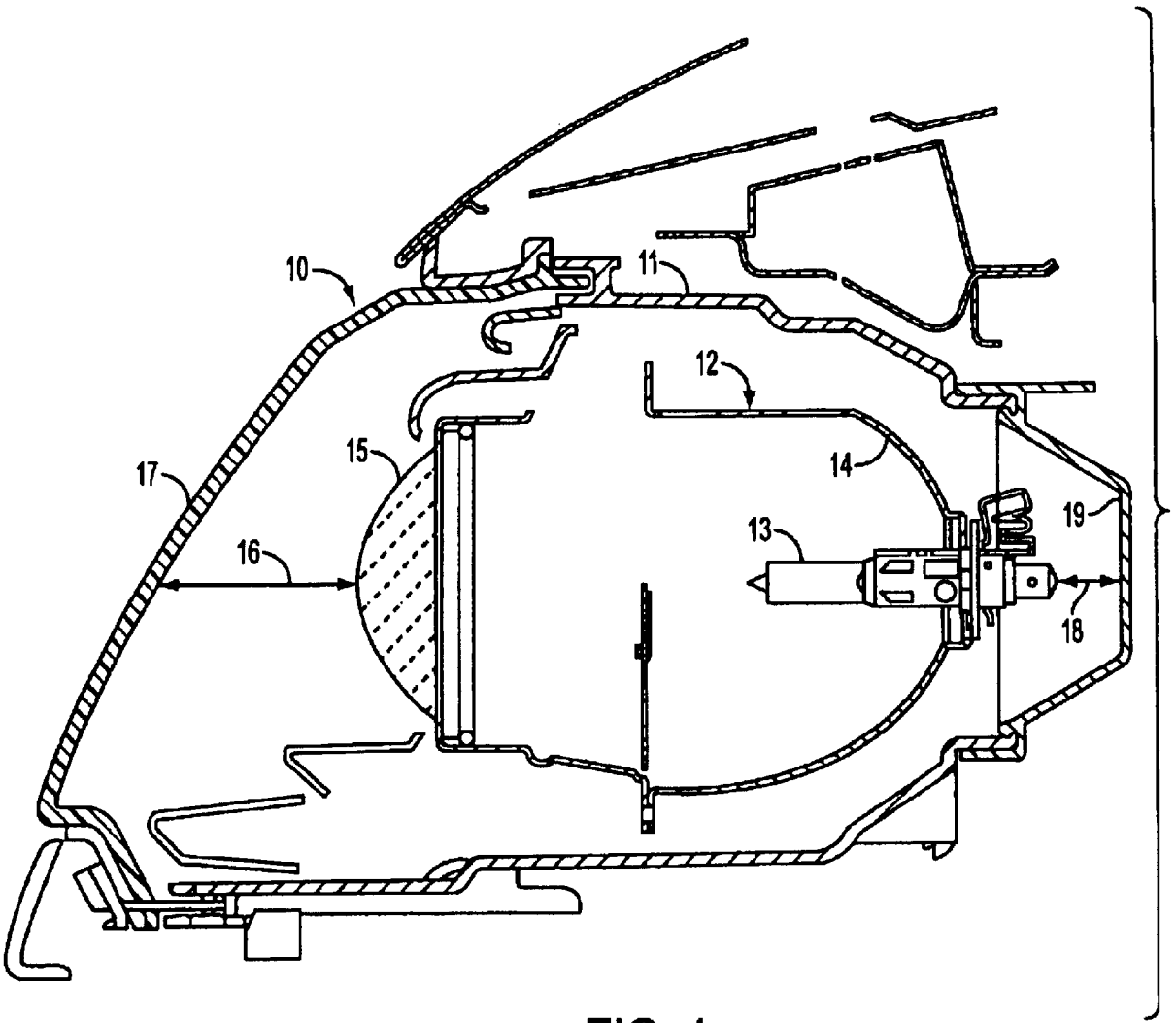
FIG. 1 (PRIOR ART)
FIG. 1 is a side elevation of a headlamp assembly according to the prior art.

FIG. 1 is a side elevation of a prior art headlamp assembly 10 wherein a housing 11 supports a headlamp projector unit 12 that includes a bulb 13, behind which is disposed a reflector 14, and in front of which is positioned a glass projector lens 15. Spaced by a gap 16 from the glass projector lens 15 is an outer polycarbonate (LEXON®) lens 17. As is seen in FIG. 1, the bulb 13 is spaced by a distance 18 from the rear wall 19 of the housing 11, which is relatively close when compared to the corresponding distance in FIG. 2.

Figure 2:
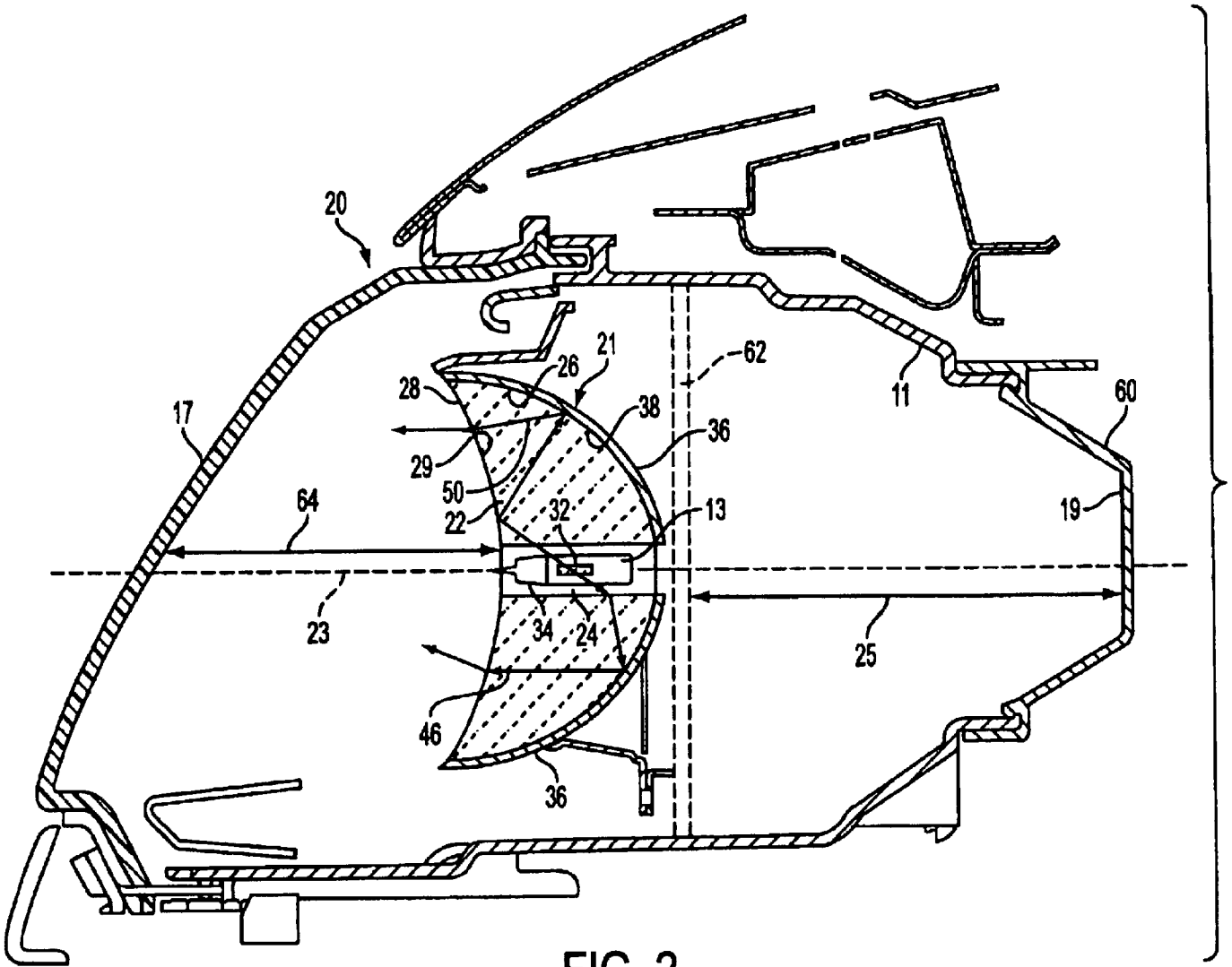
FIG. 2 is a side elevation of a headlamp assembly according to the present invention.

Referring now to FIG. 2, a side elevation is shown of a headlamp assembly 20, configured in accordance with the principles of the present invention, wherein the glass projector lens 15 is replaced by an optical system 21 comprising an optical body 22 formed about an axis 23. The optical body 22 receives the bulb 13 in a cavity 24 extending therethrough, which cavity is preferably coaxial with an axis 23 of the optical system 21. As is evident from FIG. 2, the bulb 13 of the optical system 21 is substantially closer to the outer polycarbonate lens 17. This results in space savings in the fore/aft dimension of the headlamp assembly 20. The extent of the space saved is evident by arrow 25 extending from the rear wall 19 of the housing 11 toward the bulb 13 in the optical body 22, which is substantially greater than the distance 18 from the rear wall surface 19 of the housing 11 to the bulb 13 of FIG. 1. This means that the rear wall 19 may be moved closer to the lens 17 providing space for other uses.

The optical body 22 is made of a light transmissive material such as glass and extends laterally and coaxially with respect to the axis 23. A discussion of optical bodies, such as the optical body 22, occurs in PCT patent application WO 01/69300A2, published Sep. 20, 2001, titled "High-Efficiency Non-Imaging Optics" and is incorporated herein in its entirety by reference. The optical body 22 of FIG. 1 has a convex rear surface 26 and a concave front surface 28. The concave front surface 28 has an inwardly facing convex optical surface 29. By utilizing an optical body such as the optical body 22 the diameter of the headlamp assembly 20 and thus the height and width of the headlamp assembly are also reducible.

Extending from the convex rear surface 26 toward the front surface 28 is the cavity 24 that is coaxial with the axis 23. The cavity 24 is defined by a cylindrical, light transmissive wall 32 that may have an irregular surface to shape light refracted thereby. While the cavity 24 is shown extending completely through both the convex rear surface 26 and the concave front surface 28, it is to be understood that the cavity 24 need not open through the front surface 28.

The bulb 13 that may be, for example a halogen bulb, or an HID bulb, is received in the cavity 24. If the bulb 13 is a halogen bulb, it contains a filament 30 that emits light when electrical current is applied thereto. If the bulb 13 is an HID bulb, light emits from an arc between two electrodes. A black end cap 34 on the bulb 13 blocks light from the filament 30 from exiting the bulb in the direction of axis 23 if the headlamp is a low beam or fog lamp. The end cap 34 is only needed for lamp functions that have glare requirements i.e. low beams, front fog lamps, and auxiliary low beams. Lamps having high beams and auxiliary high beams do not require a black end cap 34 since there are no glare control requirements.

The convex rear surface 26 of the optical body 22 has a reflective layer 36 thereover, which reflective layer has a concave reflective surface 38 thereon. Preferably, the reflective layer 36 is a coating of a metallic material, such as aluminum (aluminize) or another metal, such as silver or chromium. In accordance with another embodiment of the invention, the reflective layer 36 is a dichroic coating, such as a coating of silicon dioxide, suitably doped or altered to reflect substantially only those wave-lengths of light that are desirable.

As is seen in FIG. 2, light emitted from the bulb 13 is transmitted to the concave front surface 28 in two modes. The first mode is illustrated by light beam 46 that is emitted by the filament 32 or arcing in the lamp 13, and is refracted by the light transmissive wall 34 of the cavity 24 before reflecting from the concave reflective surface 38 of the reflective coating 36. The light beam 46 is then redirected by refraction through the concave front surface 28 of the optical body 22.

The second mode of light transmission through and out of the optical body 12 is illustrated by a light ray 50 that upon being emitted by the filament 30 (or arc) of the bulb 13 is injected into the optical body and refracts from the convex optical surface 29 of the concave front surface 28. This refraction is a total internal reflection of the light ray 50 back through the glass of the optical body 22, where the light ray 50 is then reflected off the concave reflective surface 38, and is redirected through the optical body and refracted out through the front surface 28 of the optical body. By so configuring a low beam or high beam headlamps or fog lamps, assemblies as illustrated by the lamp assembly 20—are compact in size while being efficient in collecting and transmitting light from the bulb 13.

The space savings illustrated by the arrow 25 in FIG. 2 are useable to move the rear portion 60 of the housing 11 toward the optical body 22, for example, to the position of rear housing wall 62 (shown in dotted lines). This provides a substantially shorter for/aft dimension for the headlamp assembly 22.

Figure 3:
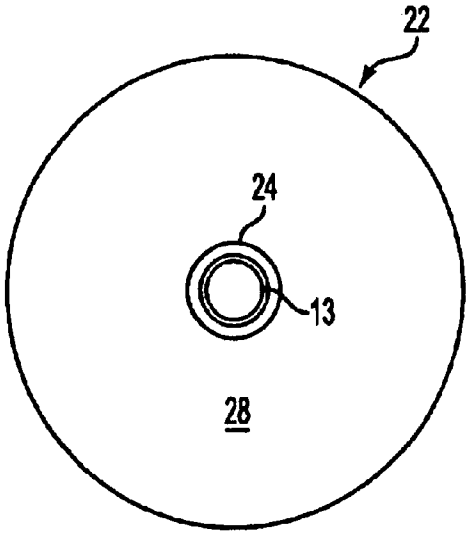
FIG. 3 is a front view of an optical body used with the headlamp assemblies according to FIG. 2.

As is seen in FIG. 3, the headlamp assemblies 20 is preferably circular and coaxial about the central axis 23, however headlamp assembly may have a square shape or any other shape, such as but not limited to, a rectangular or oval shape while still having the features of the surfaces illustrated in FIG. 2. While the axis 23 is shown as a central axis in FIGS. 2 and 3, the axis in other embodiments of the invention may be off-center.

In accordance with another embodiment of the invention, the optical body 22 is made of glass with the reflective layer 36 being a dichroic coating. The plastic lens 17 (typically made of polycarbonate, e.g. LEXON®) is separated from the front surface of the optical body by a gap 64. The gap 64 provides a thermal break that protects the lens 94 from being softened and degraded by heat from the filament 32 of the lamp 13.

To further reduce the fore/aft dimension of the headlamp assembly 20, it is desirable to minimize the width of the gap 64 in the axial direction. In accordance with the present invention, this is accomplished by configuring a dichroic coating forming the reflective layer 36 to have reflective properties for reflecting visible light and transmissive properties for transmitting infrared light therethrough to emit from rear surface 26 of the optical body 22. Since infrared light is not reflected forward into the plastic lens 17, but rather is directed back through the dichroic material of the coating 36, the heat load on the plastic lens is reduced so that the width of the gap 64 is decreased, allowing the optical body 22 to be positioned closer to the plastic lens 17. Thus, the fore/aft dimension of the headlamp assembly 22 is further reduced. In one embodiment, the dichroic coating forming the reflective layer 36 is a silicon dioxide coating of multiple layers having different refractive indices to reflect visible wavelengths of light while allowing infrared rays to pass therethrough.

In accordance with another embodiment of the invention, the dichroic coating 90 is a silicon dioxide coating tuned by doping or by other techniques to absorb and not reflect portions of yellow wavelength light. The dichroic coating tuned not to reflect portions of yellow light in accordance with one embodiment of the invention is in still another embodiment, configured to absorb and not transmit infrared light.

Figure 4:
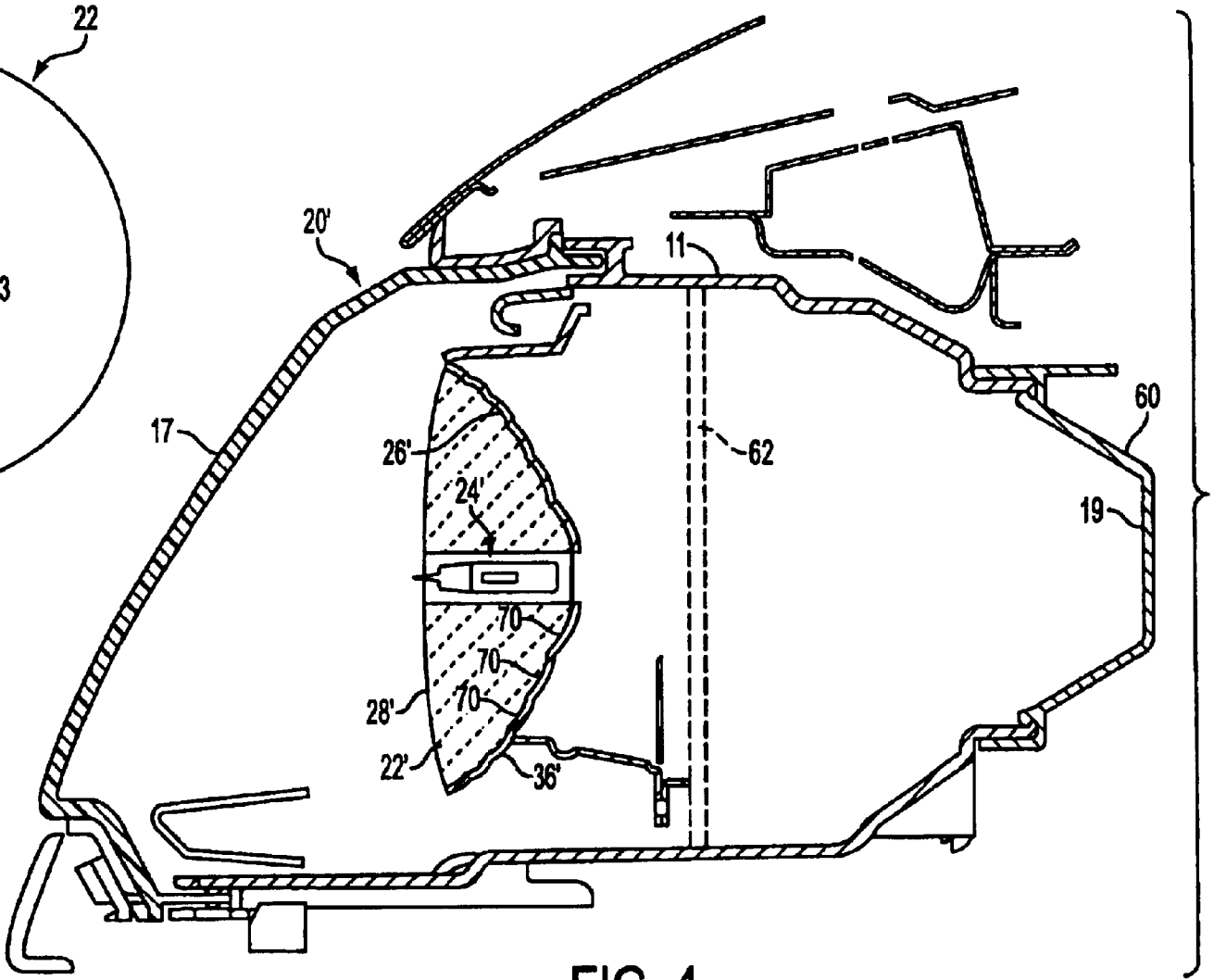
FIG. 4 is a side elevation of a second embodiment of an optical body according to the present invention.

Referring now to FIG. 4 there is shown another embodiment of the invention wherein a convex rear surface 26' of the optical body 22' of arcuate grooves 70 for reflecting light in a diffused manner toward the front of the optical body.

The terms "convex" and "concave" refer to the overall shape of the surfaces, such as the illustrated rear surfaces 26 and 26'. These terms encompass departures from continuous convexity or continuous concavity, such as but not limited to, the grooves 70 in which other shapes are superimposed on generally convex and generally concave surfaces. While the front surfaces 28 of the optical bodies 22 and 22' are illustrated as being concave, the front surfaces may also be convex or flat depending on the characteristics of the light beam being projected by the optical bodies. The front and rear surfaces may also be free form concave or free form convex as long as the surfaces serve to collimate the light beam.

By utilizing the principles of the present invention, headlamp assemblies such as headlamp assemblies 21 and 21' optical bodies have heights less than 75 mm and widths less than 100 mm. Moreover, the lengths of such headlamps 60 in the fore/aft direction, including the bulb, can be less than 100 mm (if the bulb is not included, the depth is reduced by about 55 mm).

The material of which the optical bodies 22 and 22' are made must be able to withstand heat emitted by the bulbs 30 and 80. Exemplary of such a material is a glass that has the added characteristic of accepting dichroic coatings. Exemplary of such glasses are borosilicate glass and sodalime glass. Other glasses may be used as long as optical quality is maintained, optical quality being measured by low absorption and high transmission of light. Exemplary of one of such glasses is B270 glass, available from Schott Glasswerks.

Typically, low beam headlamps have bulbs 13 emitting about 700 to about 1,700 lumens, high beam headlamps have bulbs emitting about 1270 to about 2,300 lumens, and front fog lamps use about 500 to about 1,000 lumen bulbs.

From the foregoing description, one skilled in the art can easily ascertain the essential characteristics of this invention, and without departing form the spirit and scope thereof, can make various changes and modifications of the invention to adapt it to various usages and conditions.

What is claimed is:

1. A headlamp optical system comprising:

an optical body made of a light transmissive material, the optical body being disposed about an axis and extending both laterally with respect to the axis and in the direction of the axis, the body having a rear surface and a front surface;

a cavity extending in the optical body from the rear surface toward the front surface for receiving a light source therein, the cavity being defined by a light transmissive wall for admitting light from the light source into the optical body;

a reflective surface on the rear surface of the optical body for reflecting substantially collimated light toward and through the front surface; and a plastic lens to provide a headlamp assembly, wherein the light source is a filament bulb, wherein the light transmissive material of the optical body is glass, wherein the reflective surface is a dichroic coating and has a component that reflects visible light and a component transmits infrared radiation therethrough for emission out of the back surface of the optical body, and wherein the cavity extends completely through the optical body and the filament bulb emits light laterally, axial emission being blocked by an opaque end portion of the filament bulb.

2. A vehicular headlamp assembly comprising:

an optical body made of light transmissive material, the optical body being formed about an axis and having a convex rear surface and a front surface;

a cavity extending along the axis into the optical body from the rear surface toward the front surface, the cavity being defined by a light transmissive wall that refracts light as light passes therethrough;

a bulb disposed in the cavity for emitting light laterally with respect to the axis for transmission through the light transmissive wall into the optical body;

a concave reflective coating on the substantially convex rear surface of the optical body for reflecting light from the bulb which has been refracted by the light transmissive wall in a collimated beam toward the front surface of the optical body, and a lens of plastic material positioned in front of and in spaced relation with the front surface of the optical body for refracting the collimated light reflected from the reflector out of the optical body.

3. The vehicular headlamp according to claim 2 wherein the reflective coating is a dichroic coating and the optical body is made of glass.

4. The vehicular headlamp according to claim 3 wherein the dichroic coating has both reflective and transmissive components, the reflective components reflecting visible light through the front surface of the optical body and the transmissive components emitting infrared light from the optical body through the rear surface thereof.

5. The vehicular headlamp assembly of claim 3 wherein the dichroic coating is tuned to not reflect portions of yellow wavelength light.

6. The vehicular headlamp of claim 4 wherein the dichroic coating is tuned to not reflect portions of yellow wavelength light.

* * * * *